United States Patent [19]

Hales et al.

[11] 4,449,666

[45] May 22, 1984

[54] CONCRETE RAILROAD TIE FOR SUPPORTING GRADE CROSSING PANELS

[75] Inventors: Harvey E. Hales; Edmund R. Fredrick, both of St. Augustine, Fla.

[73] Assignee: Railroad Concrete Crosstie Corporation, St. Augustine, Fla.

[21] Appl. No.: 261,775

[22] Filed: May 8, 1981

Related U.S. Application Data

[62] Division of Ser. No. 69,292, Aug. 24, 1979, Pat. No. 4,267,969.

[51] Int. Cl.[3] ..... E01B 3/28; E01C 9/04

[52] U.S. Cl. ..... 238/84; 238/8

[58] Field of Search ..... 238/1-9, 238/85, 86, 84

[56] References Cited

U.S. PATENT DOCUMENTS

| | | | |
|---|---|---|---|
| 1,071,291 | 8/1913 | Blessing | 238/86 |
| 2,875,953 | 3/1959 | Weber et al. | 238/7 X |
| 2,984,417 | 5/1961 | Voorhees | 238/8 |
| 3,371,866 | 3/1968 | Sonneville | 238/84 X |
| 4,267,969 | 5/1981 | Hales et al. | 238/8 |

FOREIGN PATENT DOCUMENTS

| | | | |
|---|---|---|---|
| 1004639 | 3/1957 | Fed. Rep. of Germany | 238/86 |

*Primary Examiner*—Randolph Reese

*Attorney, Agent, or Firm*—Arthur G. Yeager

[57] ABSTRACT

A railroad grade crossing structure comprising a plurality of prefabricated, elongated, reinforced concrete panels formed of used, inverted rail sections placed between the rails of each track and outside the rails of each track to provide a smooth durable highway surface; the panels resting on resilient pads supported on elongated crossties containing upstanding studs to fit loosely within sleeves in the bottom of the panels to prevent undue lateral movement; substantially all free space between panels and the rails of each track being filled with a settable elastomeric compound; the end panels adjacent the shoulders of the highway having an upper surface substantially flush with the highway surface and sloping downwardly to the lower surface of the panel which rests on the resilient pads.

2 Claims, 12 Drawing Figures

FIG.10
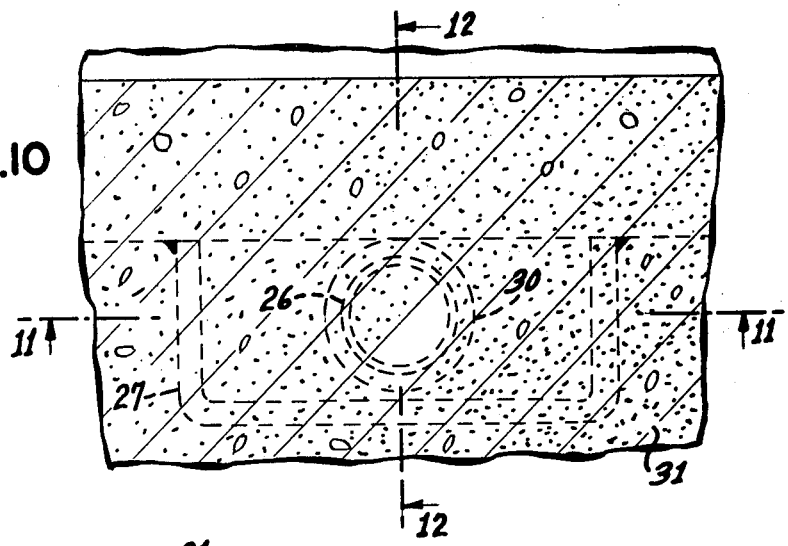
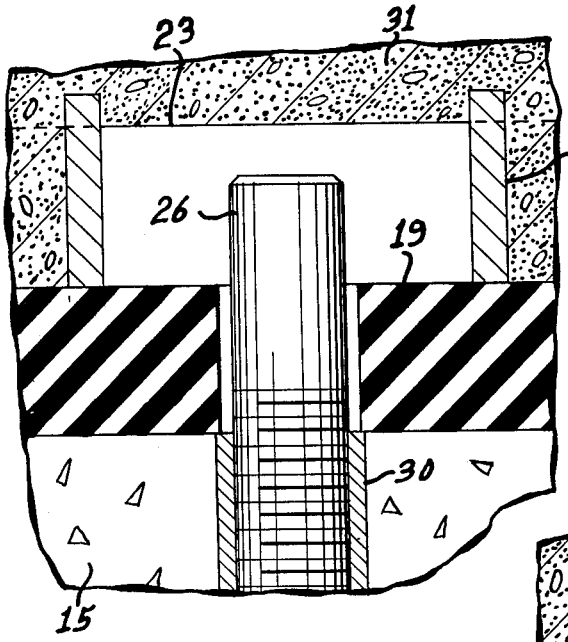
FIG.11
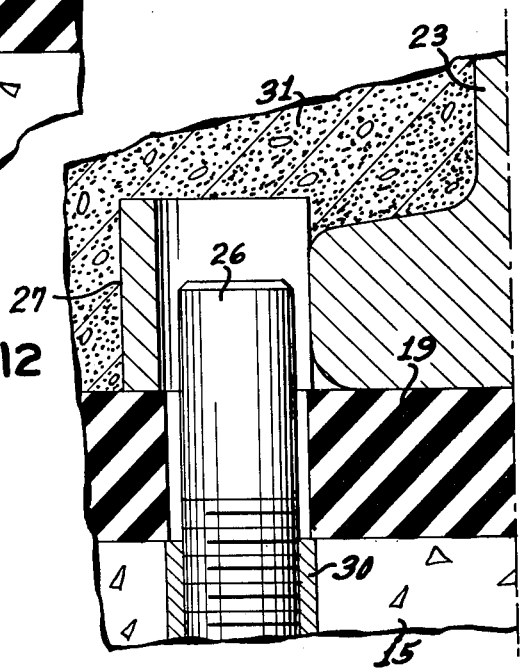
FIG.12

CONCRETE RAILROAD TIE FOR SUPPORTING GRADE CROSSING PANELS

This is a division of application Ser. No. 069,292, filed Aug. 24, 1979, now U.S. Pat. No. 4,267,969.

BACKGROUND OF THE INVENTION

The problem of constructing smooth and durable grade crossings where highways and railroads intersect has been a difficult one to solve on a long term basis. Modern structures normally provide reinforced concrete panels which can either be prefabricated or constructed in place. Because of the normal flexibility of the rails which deflect as a train passes over them, it has not been easy to design such a crossing to provide such flexibility and yet provide the normal rigidity required of a highway surface. Most of the modern structures are directed to the prefabricated panels which are joined in some fashion to the running railroad rails so as to be deflected along with the rails when the train passes over and to remain relatively rigid when automobiles are crossing in the other direction. Typical of the modern devices are those shown in U.S. Pat. No. 3,341,123 to Holthausen; U.S. Pat. No. 3,863,840 to Szarka et al; and U.S. Pat. No. 3,955,761 to Szarka et al. The constructions of the prior art employ special clips or bridging members that can be bolted to the tie supporting the main rail and thereby rigidly attach the prefabricated panel to the rail and its supporting tie so that the entire combination will move and flex together. This is now believed to be an undesirable feature if the proper type of crossties and their associated structures are employed. Another disadvantage of some of these prior art structures is that the panels are positioned as closely as possible to the running rails so as to provide a smooth surface for the automobile crossing, but in so doing open spaces are often left on each side of the rail which may catch foreign objects passing over the crossing and collect dirt and trash that cannot be easily removed.

It is an object of the present invention to provide an improved grade crossing structure that is uncomplicated by clips and bridge members joining the panels to the rails and which leaves no open spaces except that which is necessary for the flanges on the wheels of the railroad cars.

BRIEF SUMMARY OF THE INVENTION

This invention provides a railroad grade crossing in which a highway intersects a pair of parallel railroad rails supported by and affixed to a plurality of parallel ties. The associated structure which interfaces the highway and the rails comprises an interior panel between the pair of rails and two exterior panels joining the outside of each rail to the highway, each of the interior and the exterior panels being generally in the shape of right rectangular prism having an upper rectangular surface, a lower rectangular surface, and four rectangular sides, each panel being constructed of four railroad rail sections forming the sides of the panel and being positioned with the base of the rail in the upper surface of the panel; the four rail sections being joined with sufficient reinforcing metal cross pieces to produce a rigid structure and with all the remaining space between the upper and lower surfaces of the panel interiorly of the four rail sections filled with structural concrete, and with all exterior irregularities including the exterior portion around the four rail section filled with an elastomeric compound; each panel having on its lower surface near each corner a guide sleeve cooperating with a stud, firmly attached to and upwardly projecting from, one of the parallel ties; each panel being supported on a plurality of said parallel ties and separated therefrom by a layer of an elastomeric compound. The space between the main rails and the panels are also filled with the elastomeric compound except for a groove on the inside edge of each of the rails of sufficient size to accommodate the wheel flanges on the railroad equipment and cars passing by.

BRIEF DESCRIPTION OF THE DRAWINGS

The novel features believed to be characteristic of this invention are set forth with particularity in the appended claims. The invention itself, both as to its organization and method of operation together with further objects and advantages thereof, may best be understood by reference to the following description taken in connection with the accompanying drawings in which:

FIG. 10 is a plan view of one of the guide sleeves and studs which hold the panels in place in this invention.

FIG. 11 is a partial cross sectional view in elevation taken along line 11—11 of FIG. 10.

FIG. 12 is a partial cross sectional view in elevation taken along line 12'12 of FIG. 10.

DETAILED DESCRIPTION OF THE INVENTION

Figure 1:
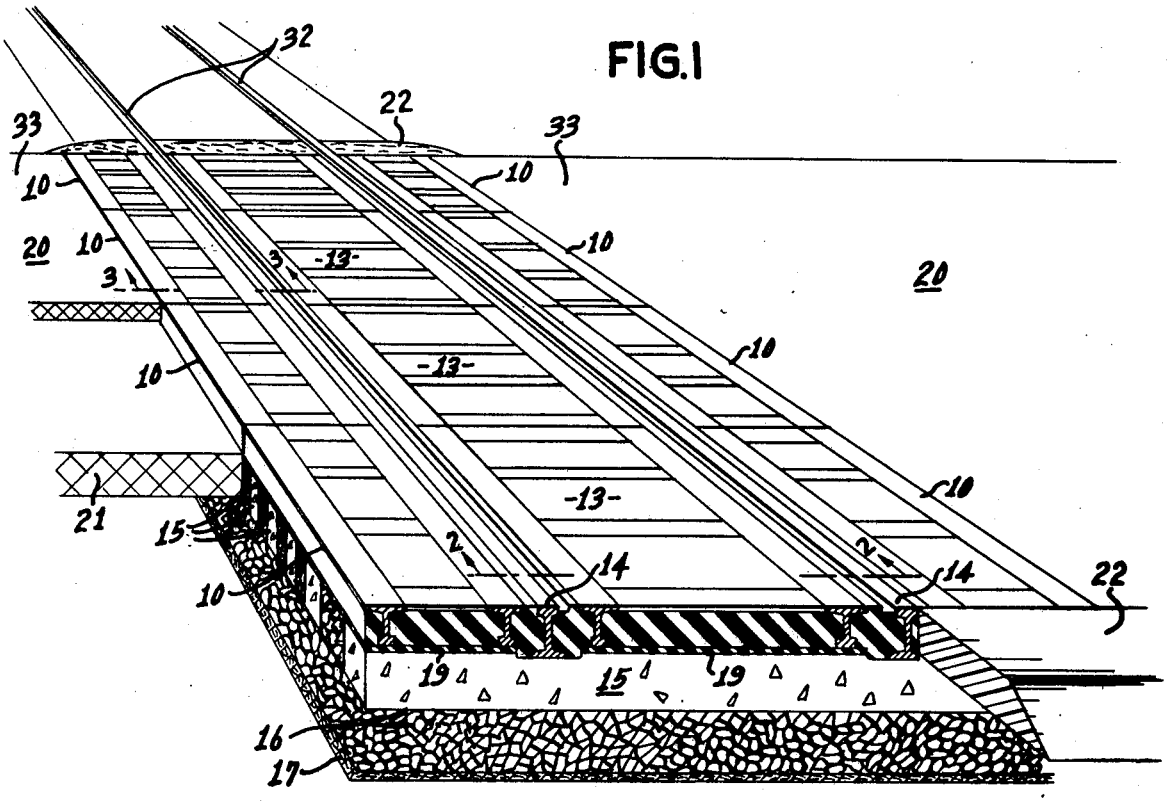
FIG. 1 is a perspective view of the grade crossing of this invention.

In FIG. 1 there is shown the simple intersection of a pair of railroad rails 32 with a highway 33. It is to be understood that this invention is not limited to the simple intersection of a single pair of rails and a single highway since it is adaptable to any number of rails, whether straight or curved and whether parallel or intersecting. It is only for the sake of brevity that FIG. 1 shows a single pair of rails since the same components and features described here can be multiplied in order to be employed with multiple tracks and larger highways.

The entire space between the highway surface 20 on one side of the rails and the highway surface 20 on the other side of the rails is filled with an appropriate number of panels which may be interior (i.e. between a pair of rails) or may be exterior (i.e. outside of any pair of rails). Four exterior panels 10 are shown stretching across the road on the outside of one of the rails 14 and four similar exterior panels 10 are placed outside the other of rails 14. Similarly four interior panels 13 are placed between the rails 14. For a typical highway section which is approximately 40 feet in width each of these panels would be approximately 10 feet long and 5–6 inches thick. The exterior panels would be approximately 2 feet wide and the interior panel approximately 8 inches less than the gauge of the railroad (e.g. 4 feet).

Rails 14 and each of panels 10 and 13 are supported by a plurality of parallel ties 15 which are generally perpendicular to rails 14. While rails 14 rest directly on ties 15, panels 10 and 13 are separated from ties 15 by an elastomeric pad 19 which provides a certain flexibility for the panels and permits different thicknesses of pad 19 to be employed to make the upper surfaces of panels 10 and 13 as close as possible to being level with the top of the head of rails 14 in order to provide the smoothest surface possible for the highway crossing. The support for ties 15 is the usual rock ballast 16 which is found in railroad construction. It has also been found advisable to separate rock ballast 16 from subgrade 18 by fibrous pad 17 which is tough and yet sufficiently porous to permit water to permeate through it. Such a pad prevents subgrade 18 from working its way upward with its attendant fine particles and moisture into ballast 16 and eventually causing level of rails 14 to subside. These pads are in use in modern construction of railroad supports. A typical pad is one having a random distribution of synthetic fibers in a matrix of elastomeric material. One material in use for such purposes is FABCO bearing pads made and sold by Fabreeka Products Company of Boston, Mass.

Ties 15 are substantially rectangular, and are preferably generally square, in cross section and have a length approximately the same as the transverse distance across the entire crossing structure from the edge of highway 33 on one side of the crossing to the edge of highway 33 on the other side of the crossing. For a single track crossing this length would be approximately twice the gauge of the rails. The tie is preferably made of reinforced, prestressed concrete.

The highway which meets this railroad crossing is normally comprised of a rock base 21 on top of subgrade 18 and a finish layer 20 which may be asphalt or concrete as desired. Such a road construction abuts the outsides of panels 10. A proper road construction normally also requires sloped shoulders 22 to be included so as to provide some safety for those using the crossing who may be too close to the edge of highway 33 for proper safety, and more importantly, to lift any equipment dragging from or by the train so as to prevent damage.

Figure 2:
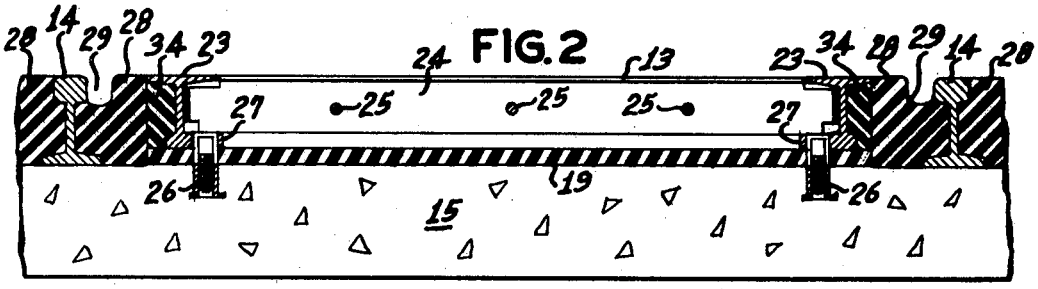
FIG. 2 is a cross sectional view in elevation taken along line 2—2 of FIG. 1.
Figure 3:
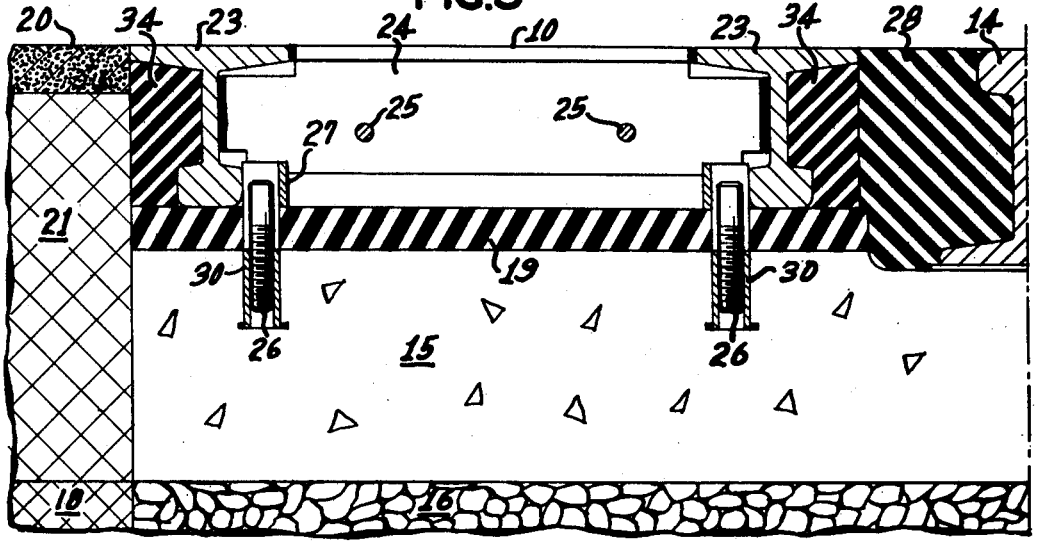
FIG. 3 is a cross sectional view in elevation taken along line 3—3 of FIG. 1.

In FIG. 2 and FIG. 3 there may be seen the details of the construction of interior panels 13 and exterior panels 10, respectively, and how each panel is attached to ties 15. Each of panels 10 and 13 is of the same general rectangular shape, differing only in width. Preferably each panel is of substantially the same length as shown in FIG. 1. Each panel is comprised of 4 external rail sections 23 positioned upside down, i.e. the head of the rail in the lower surface of the panel and the base of the rail in the upper surface of the panel. The four rail sections are cut in any appropriate manner so as to be welded rigidly to form the four sides of the panel. In order to provide appropriate reinforcement there are additional rail sections 24 and rods 25 to produce a network interiorly of the rectangular panel to support and reinforce the structural concrete which is employed to fill all of the remaining space inside of the four rail sections from the top to the bottom of the panel. The rail sections which are employed for the sides 23 or for the reinforcement portions 24 are usually worn or used railroad rails, frequently of a smaller size than that of the main rail 14. For example, main rail 14 may be 132 lb. rail while rail sections 23 and 24 may be 90 lb. rail. The width of panels 10 and 13 (transverse to rails 14) is generally less than the length (parallel to rails 14) of such panels and reinforcing rails 24 are preferably laid only in the transverse direction with reinforcing rods 25 laid principally in the long direction with one or more in the transverse direction to supply whatever structural rigidity is required. Transverse reinforcing rail sections 24 are cut appropriately at the ends of the sections to fit into the base and web portions of rail sections 25 with sufficient clearance that they may be welded into place. Those reinforcing rail sections 24 are also drilled with holes which will permit rods 25 to be inserted therethrough to be welded or otherwise fixed into place. When this network (which is more completely shown in FIGS. 4–9) is completed the entire interior space is then filled with structural concrete. The external space 34 around the sides of panels 10 and 13 is "squared off" by filling it with a liquid, settable elastomeric casting compound so that when similar panels are placed in a abutting relationship to each other there will be no voids to permit rusting, accumulation of dirt etc. It is not necessary that the long sides of the panels be filled in this fashion prior to assembly at the railroad grade crossing since the space between the panel and rail 14 is to be filled with the same type of elastomeric compound and the entire space could be filled at that time. It may be convenient, however, for manufacturing purposes that the four sides of each panel by "squared off" in this fashion before assembly at the site.

Each panel has at least four sleeves 27 welded to the head of rail sections 23, generally one in each internal corner of the panel. It may be preferable in some instances to employ more than four sleeves for each panel, if the length or the width of the panel is large. Sleeves 27 cooperate with studs 26 which are rigidly affixed to and project upwardly from ties 15. Ties 15 are shown in these drawings to be concrete, but it is not necessary that this be so since wooden ties or metal ties are likewise usable. In any event, a corresponding number of studs are affixed to ties 15 so that when panels 10 and 13 are placed thereon to construct the railroad grade crossing, each of studs 26 will fit inside of a respective sleeve 27. These sleeves and studs will be more fully described with respect to FIGS. 10–12. It is not critical how studs 26 may be affixed to ties 15. If the ties 15 are concrete the studs may be embedded in the concrete when it is poured. Preferably, threaded anchor sleeves 30 are placed in the forms for ties 15 before the concrete is poured and studs 26 may thereafter be screwed into place. In general, the cooperation between studs 26 and sleeves 27 is that a very loose fit is provided merely to prevent panels 10 and 13 from moving laterally any substantial amount. Although, a plurality of parallel ties 15 provides the support for the weight of panels 10 and 13, an elastomeric pad 19 is sandwiched between the two in order to provide a better seating for the panel, to minimize irregularities there may be on the top surface of ties 15, to provide a vibration dampener, and to provide some flexibility for the passing of vehicles over the panels and the passing railroad trains over rails 14. Pad 19 is made in a variety of thicknesses so that different combinations of different thicknesses may be employed as shims to bring the upper surface of panels 10 and 13 as close as possible to the level of the upper surface of rail 14. There is a need for some adjustment, by way of, for example shims, to assure that the upper surface of panels 10 and 13 and their abutting panels over the entire grade crossing will provide a substantially flat planar surface.

The space between rails 14 and either or both of panels 10 and 13 is filled with the same liquid, settable elastomeric casting compound as employed to "square off" each of panels 10 and 13. This space between panels and rails 14 is shown at 28 and it may be filled on the site after all the panels are in place. It is filled to the top of rail 14 and panels 10 and 13 except for a groove 29 which will permit the passage of the normal flanges on the wheels of the railroad equipment and cars. In FIG. 3 it is shown how paving 20 and rock base 21 might fit against the edge of panel 10 and tie 15. If the edge of paving 20 and rock base 21 can be made precisely to meet the edge of panel 10, the previous filling of the irregular space 34 by the panel manufacturer will suffice, but if there is some additional space between the two, it might be filled with the same type of elastomeric compound employed in space 34.

It should be noted that in FIG. 2 panel 13 is made as one piece having a width which conforms approximately to the distance between rails 14. It is, of course, entirely possible that this space be divided into two or more panels rather than one panel and that is considered to be a part of this invention. If this panel 13 is divided into two panels it would be entirely feasible to make panels 10 and the halves of panels 13 exactly the same size and shape.

Figure 4:
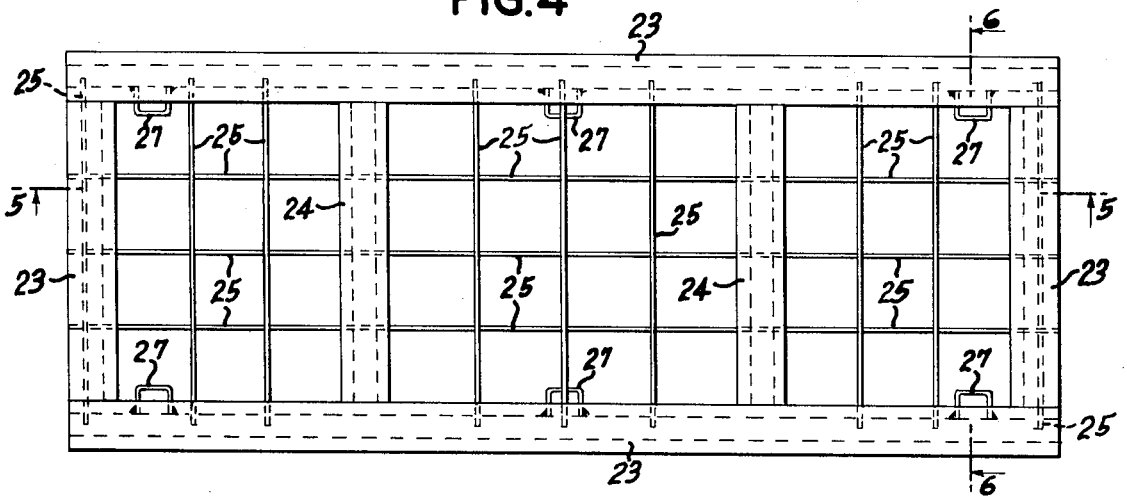
FIG. 4 is a plan view of one of the interior panels of this invention before it is filled with concrete.
Figure 5:
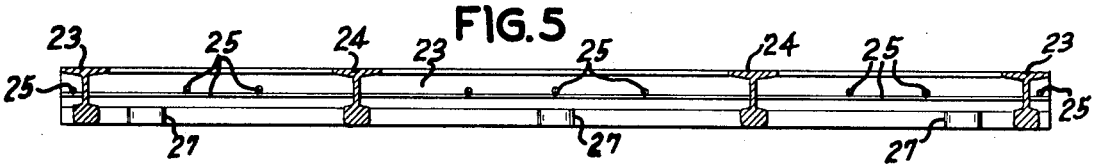
FIG. 5 is a cross sectional view in elevation taken along line 5—5 of FIG. 4.
Figure 6:
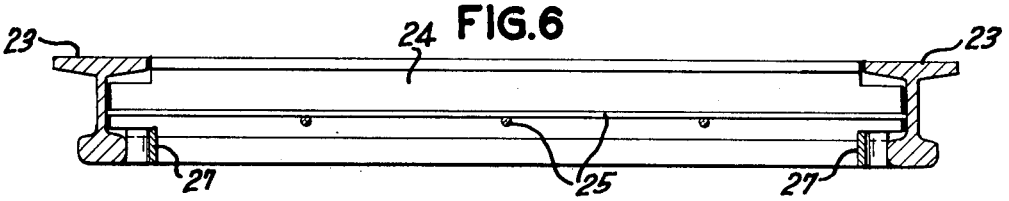
FIG. 6 is a cross sectional view in elevation taken along line 6—6 of FIG. 4.
Figure 7:
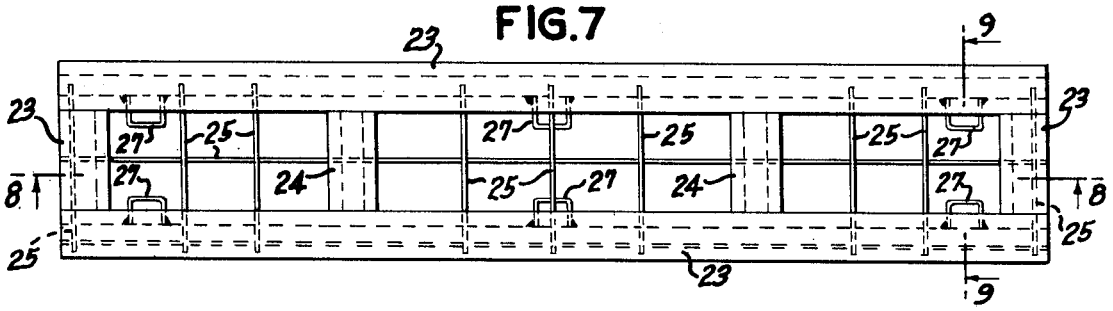
FIG. 7 is a plan view of one of the exterior panels of this invention before it is filled with concrete.
Figure 8:
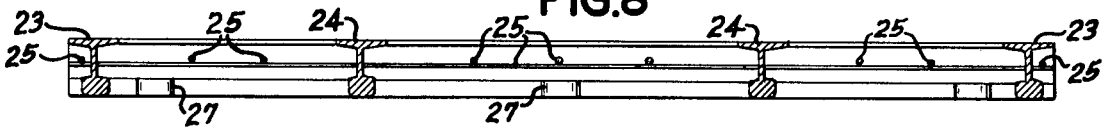
FIG. 8 is a cross sectional view in elevation taken along line 8—8 of FIG. 7.
Figure 9:
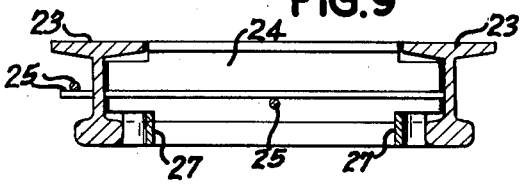
FIG. 9 is a cross sectional view in elevation taken along line 9—9 of FIG. 7.

In FIGS. 4–9 there are shown the details of the skeletons of panels 10 and 13 prior to being filled with structural concrete. The details of these two panels are identical in all respects except that the larger panel 13 as shown in FIGS. 4–6 has more reinforcing rods 25 than does panel 10 as shown in FIGS. 7–9. In each of panels there are four outside rail sections 23 with two reinforcing rail sections 24 parallel with the short side of the rectangular panel and substantially equally spaced with respect to the end sections 23. In order to tie these reinforcing rails together an appropriate network of reinforcing rods 25 is employed in the usual manner of preparing reinforced concrete. Holes are provided in the webs of rail sections 23 and 24 to accomodate rods 25 and the entire structure is preferably welded at all junctions and points of intersection so as to maintain its rigidity. Sleeves 27 are also welded at appropriate locations to the heads of outside rails 23. A minimum of four such sleeves is needed (one in each corner of the panel) although additional sleeves 27 may be employed if desired. Normally such sleeves will be employed in pairs on opposite sides of the panel, and they must be positioned to match corresponding studs affixed to the supporting cross ties underneath this structure. Because of the width of panel 13 as shown in FIG. 4 there are three longitudinal reinforcing rods 25 as compared to one in the more narrow panel 10 as shown in FIG. 7.

In FIGS. 10–12 there is shown in detail the arrangement of sleeves 27 and studs 26. Sleeve 27 is a short section of a channel with the legs of the channel welded to the head of rail 23. Stud 26 is fixed with respect to tie 15 and projects upwardly from the upper surface thereof a sufficient distance to extend through pad 19 and into the interior open space of sleeve 27. Stud 26 may be screwed directly into an anchor sleeve 30 embedded in the concrete of tie 15 when that tie is being formed. If tie 15 is wood, stud 26 may be screwed into place after the fashion of large lag screws employed in railroad construction. If tie 15 is metal, stud 26 may be bolted into place or welded as desired. In any event stud 26 is rigidly fixed to tie 15 and is sufficiently long for its upper end to project into the interior portions of sleeve 27 and thus serve as a guide to prevent the panel to which sleeve 27 is affixed from moving any substantial amount in a lateral direction. There is considerable clearance (e.g. ½ to 1 inch) between sleeve 27 and stud 26 but this amount of clearance is negligible for panels 10 feet or more in length. The method of attachment of stud 26 to tie 15 shown in these drawings is by means of a threaded anchor sleeve 30 embedded in tie 15 to serve as a receiver for a threaded portion of stud 26. The positioning of the top of stud 26 as compared to the height of sleeve 27 is such that the normal vibrations and deflections caused by the passage of automobiles or trains over the grade crossing will permit a certain amount of vertical movement without permitting the top of stud 26 to go beyond the top of sleeve 27 nor below the top of pad 19. The passage of railroad cars naturally causes a deflection of the rails which moves ties 15 downward slightly and this moves stud 26 downward to the same extent. On the other hand, the passage of automobiles and trucks over the crossing causes deflection of panels 10 and 13 because of the compression of pad 19, which in turn, causes the top of stud 26 to more closely approach the top of sleeve 27. In a properly assembled grade crossing the height of sleeve 27 is not more than about 2–3 inches and the positioning of stud 26 is normally placed so that when there is no compression or deflection by traffic overhead the top of stud 26 will be about half way between the top and the bottom of sleeve 27.

While the invention has been described with respect to certain specific embodiments, it will be appreciated that many modifications and changes may be made by those skilled in the art without departing from the spirit of the invention. It is intended, therefore, by the appended claims to cover such modifications and changes as fall within the true spirit and scope of the invention.

What is claimed as new and what is desired to secure by Letters Patent of the United States is:

1. An elongated reinforced prestressed concrete railroad tie for positioning beneath and supporting throughout its length interior panels between railroad rails and exterior panels adjacent to and outwardly of each of the rails with the panels and rail upper surfaces being substantially in the same plane, said tie being generally square in cross section and approximately twice as long as the gauge of the rails it is designed to support, said tie having a multiplicity of non-adjustable spaced studs embedded therein and projecting vertically upward from the upper surface of said tie and entering outwardly unexposed portions of the exterior and interior panels between the rails and the exterior panels adjacent to and outwardly of each of the rails and for permitting vertical movement of the interior and exterior panels with respect to said tie, said studs being the sole attachment to and non-supportive of the interior and exterior panels, said tie being adapted to be placed beneath and attached to the rails to support same thereon.

2. The tie of claim 1 in which two of said studs are positioned interiorly of the support locations for the rails, at least one of said studs is positioned between the support location for one of the rails and the adjacent end of said tie, and at least one of said studs is positioned between the support location for the other of the rails and the respective adjacent end of said tie.

* * * * *